US005832835A

United States Patent [19]

Scheuhing

[11] Patent Number: 5,832,835

[45] **Date of Patent: *Nov. 10, 1998**

[54] SOFT DOCTORING CUP

[75] Inventor: Robert B. Scheuhing, Rindge, N.H.

[73] Assignee: Markem Corporation, Keene, N.H.

[ * ] Notice: This patent issued on a continued prosecution application filed under 37 CFR 1.53(d), and is subject to the twenty year patent term provisions of 35 U.S.C. 154(a)(2).

[21] Appl. No.: 679,527

[22] Filed: Jul. 12, 1996

[51] Int. Cl.[6] ..... B41F 21/00; B41F 17/00

[52] U.S. Cl. ..... 101/493; 101/41; 101/163; 15/256.5

[58] Field of Search ..... 101/163, 167, 101/169, 170, 333, 41, 493; 73/822, 866.4, 432.1; 15/256.5

[56] References Cited

U.S. PATENT DOCUMENTS

| | | | |
|---|---|---|---|
| 3,384,931 | 5/1968 | Cochran et al. | 18/30 |
| 3,656,428 | 4/1972 | Duncan | 101/129 |
| 3,701,317 | 10/1972 | Miyamoto et al. | 101/170 |
| 3,868,902 | 3/1975 | Bradshaw et al. . | |
| 3,916,784 | 11/1975 | Dubuit . | |
| 4,060,031 | 11/1977 | Philipp | 101/163 |
| 4,085,672 | 4/1978 | Grosart . | |
| 4,151,797 | 5/1979 | Dunsirn . | |
| 4,184,429 | 1/1980 | Widmer . | |
| 4,314,504 | 2/1982 | Combeau | 101/41 |
| 4,446,743 | 5/1984 | Gunderson | 73/822 |
| 4,466,348 | 8/1984 | Buhrer . | |
| 4,508,032 | 4/1985 | Philipp | 101/163 |
| 4,557,195 | 12/1985 | Philipp | 101/163 |
| 4,615,266 | 10/1986 | DeRoche et al. | 101/163 |
| 4,621,386 | 11/1986 | Hill | 15/104.1 R |
| 4,638,733 | 1/1987 | Schneider et al. | 101/114 |
| 4,709,632 | 12/1987 | Samuels et al. | 101/163 |
| 4,738,198 | 4/1988 | Sillner . | |
| 4,779,531 | 10/1988 | Ueno et al. | 101/163 |
| 4,854,230 | 8/1989 | Niki et al. | 101/123 |
| 4,905,594 | 3/1990 | Phillip et al. | 101/163 |
| 4,940,354 | 7/1990 | Holderegger et al. | 403/5 |
| 5,003,872 | 4/1991 | Dalferth | 101/163 |
| 5,027,513 | 7/1991 | Allison, Jr. | 30/169 |
| 5,222,433 | 6/1993 | Philipp | 101/163 |
| 5,224,424 | 7/1993 | Layland | 101/425 |
| 5,237,922 | 8/1993 | Ho et al. | 101/333 |
| 5,272,972 | 12/1993 | Tobita | 101/163 |
| 5,272,973 | 12/1993 | Chojnacki | 101/163 |
| 5,320,037 | 6/1994 | Harris | 101/163 |
| 5,337,079 | 8/1994 | Spehrley, Jr. et al. | 347/88 |
| 5,363,761 | 11/1994 | Galassi | 101/163 |
| 5,383,398 | 1/1995 | Binnen | 101/41 |
| 5,388,515 | 2/1995 | Schneider et al. | 101/363 |

(List continued on next page.)

FOREIGN PATENT DOCUMENTS

| | | |
|---|---|---|
| 1077678 | 3/1960 | Australia . |
| 1004736 A3 | 1/1993 | Belgium . |
| 1923374 | 2/1970 | Denmark . |
| 0140165A2 | 5/1985 | European Pat. Off. . |
| 0287002 B1 | 11/1994 | European Pat. Off. . |
| 0736380 A1 | 10/1996 | European Pat. Off. . |
| 2205430 | 3/1980 | Germany . |
| 3713027 A1 | 11/1988 | Germany . |
| 42105821 A1 | 3/1993 | Germany . |
| 59-202856 | 11/1984 | Japan . |
| 210877 | 11/1968 | Russian Federation . |
| 1 544 748 | 4/1979 | United Kingdom . |
| 2171645 | 9/1986 | United Kingdom . |
| 2256172 | 5/1991 | United Kingdom . |

*Primary Examiner*—Eugene Eickholt
*Attorney, Agent, or Firm*—Fish & Richardson P.C.

[57] ABSTRACT

A doctoring cup particularly suited for inking non-flat plates includes a plate contacting edge with an "Ease of Flex" parameter greater than about 0.020 $lb^{-1}$. Ease of Flex is defined as $1/(Mt^2)$, where t is the thickness of the plate contacting edge and M is the flexural modulus of the material from which the cup wall defining the edge is formed. By non-flat plates is meant plates out of flat by greater than 0.0002 inches/inch. The doctoring cup can be used to ink both flat and non-flat printing plates using a doctoring pressure of less than about 300 psi.

15 Claims, 5 Drawing Sheets

U.S. PATENT DOCUMENTS

| | | | |
|---|---|---|---|
| 5,392,706 | 2/1995 | Drew, II et al. | 101/170 |
| 5,408,926 | 4/1995 | Alder | 101/170 |
| 5,410,961 | 5/1995 | DeNicola et al. | 101/363 |
| 5,450,184 | 9/1995 | Yanai et al. | 15/256.5 |
| 5,469,786 | 11/1995 | Harris | 101/163 |
| 5,476,040 | 12/1995 | Kleist | 101/163 |
| 5,537,921 | 7/1996 | Adner et al. | 101/35 |
| 5,578,364 | 11/1996 | Drew, II et al. | 101/163 |
| 5,662,041 | 9/1997 | Kleist | 101/163 |
| 5,664,496 | 9/1997 | Schsuhing et al. | 101/169 |
| 5,694,847 | 12/1997 | Kliest | 101/35 |

SOFT DOCTORING CUP

BACKGROUND OF THE INVENTION

The invention relates to closed ink cups for doctoring gravure printing plates.

Doctoring ink cups are generally very rigid to ensure long wear life. Gravure printing plates used with the cups are generally made of hardened steel and are required to be extremely flat (within 0.0002 inches/inch) in order to provide a good ink seal with the equally flat doctoring ink cup edge. Due to high costs associated with the combination of hard flat doctoring ink cups and hard flat plates, soft, flexible, non-flat plates are being used.

Soft, non-flat plates when used with hard doctoring ink cups may be easily damaged resulting in poor doctoring quality. Increasing the pressure on the cup, while resulting in a marginal improvement in doctoring quality, may further damage the plate.

SUMMARY OF THE INVENTION

The soft doctoring cup of the invention addresses these problems by conforming to non-flat plate surfaces at minimal doctoring loads resulting in acceptable doctoring of plates that are up to three times less flat than the old limits of acceptable flatness.

A doctoring cup particularly suited for inking non-flat plates includes a plate contacting edge with an "Ease of Flex" parameter greater than about 0.020 $lb^{-1}$. Ease of Flex is defined as $1/(Mt^2)$, where t is the thickness of the plate contacting edge and M is the flexural modulus of the material from which the cup wall defining the edge is formed. By non-flat plates is meant plates out of flat by greater than 0.0002 inch/inch.

Preferred embodiments have an Ease of Flex in the range of about 0.020 to 0.80 $lb^{-1}$, edge thickness in the range of about 0.005 to 0.030 inches, and a flexural modulus in the range of about 50,000 to 1,700,000 PSI. The plate contacting edge is formed of a material that allows the doctoring cup to ink non-flat plates. The doctoring cup can be used to ink both flat and non-flat printing plates using a doctoring pressure of less than about 300 psi.

According to another aspect of the invention, a method of designing a doctoring cup for doctoring a non-flat plate includes determining an acceptable range of ease of flex values for a doctoring cup having a particular modulus and edge thickness that will allow the cup to ink a non-flat plate at a desired doctoring quality.

Preferred embodiments include determining the acceptable range of ease of flex values by providing a first doctoring cup having a given geometry; doctoring the non-flat plate; testing the quality of the doctoring; providing a second doctoring cup having the given geometry and an edge thickness and/or a modulus that is different from the first doctoring cup; and repeating the doctoring of the non-flat plate and testing of the quality of the doctoring.

Advantages of the soft doctoring cup of the invention include high-quality doctoring of non-flat plates, and doctoring at lower pressures for both flat and non-flat plates. For example, with flat plates (less than 0.0002 inch/inch), steel cups generally doctor at about 300 PSI and the soft cup doctors at less than 100 PSI; with slightly out of flat plates (0.00025 to 0.0003 inch/inch), steel cups doctor at pressures much greater than 300 PSI and the soft cup doctors at less than 150 PSI; with non-flat plates (greater than 0.0003 inch/inch), steel cups do not doctor acceptably and the soft cup doctors at less than 300 PSI. The lower doctoring pressures associated with the soft cup prolong the life of the plate. The soft cup is generally formed of a material that is less expensive than traditional cup materials and more easily fabricated. The soft cup also eliminates build up of cured resin and titanium oxide pigment along the sides of a cup and plate that occurs during prolonged doctoring with traditional cups when using UV curable inks. This build up is due to the UV resin in the ink curing due to heat build up under the poorly lubricated edges at the sides of the cup. The resin and pigment abrade the cup edges resulting in premature failure of the cup and plate. The soft cups do not generate as much heat as traditional cups.

Further advantages of the soft cup of the invention may include one or more of the following. A plastic that repels ink can be chosen for the cup material resulting in more ink being left in the plate legend as compared to metal cups which attract ink. A plastic that repels ink facilities cleaning of the soft cup. Solvents last longer when used with the soft cup. Non-pad printing inks may be run in the soft cups. The soft cup improves with use since the plate motion burnishes the soft cup. The soft cup can be used with a water-washable polymer plate without damaging the plate even when the plate is softened by humidity. The soft cups are not easily damaged and are easier to repair than conventional cups.

Other features and advantages will be apparent from the following description and from the claims.

DESCRIPTION OF THE PREFERRED EMBODIMENT

Figure 1:
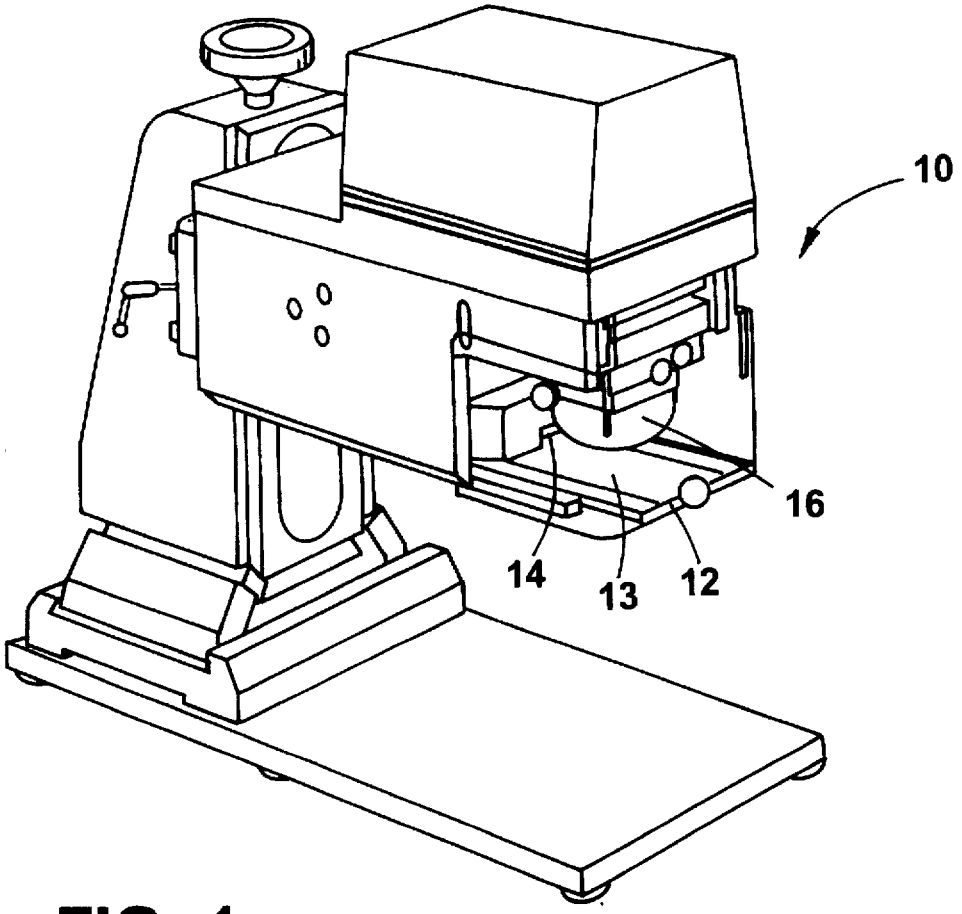
FIG. 1 is a diagrammatic representation of a pad-type doctoring machine.
Figure 2:
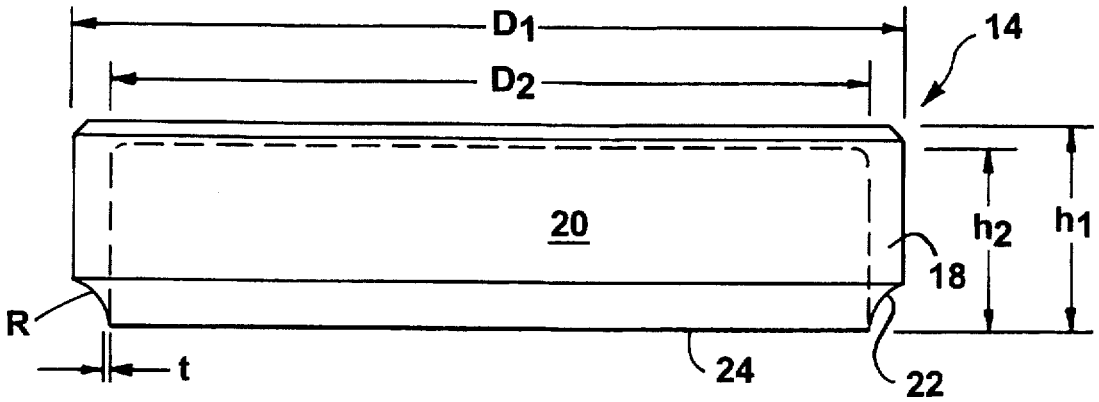
FIG. 2 is a side view of a doctoring ink cup of the invention.

Referring to FIG. 1, a pad type printing machine 10 includes a printing plate 12 with a plate surface 13 having a desired legend etched thereon, a soft doctoring ink cup 14, and a pad 16. Referring to FIG. 2, cup 14 includes a circumferential wall 18 defining an ink chamber 20. Cup 14 has a height $h_1$ of 0.562" +/−0.010" and diameter $D_1$ of 2.250"−2.245"; ink chamber 20 has a height $h_2$ of 0.500"+/−0.005" and diameter $D_2$ of 2.062"+/−0.010". An edge wall section 22 of radius R of 0.125" defines a plate contacting edge 24 having a thickness t in the range of about 0.005"−0.030", preferably about 0.005"−0.012" (see appendix A for thickness values tested).

The flatness requirement of plate contacting edge 24 can be determined based upon the flatness of the intended plate 12. The doctoring performance for a particular cup/plate combination is affected by the combined non-flatness of the cup and the plate. Steel cups are generally held to within 0.00002 to 0.00005 inches per inch flatness to allow doctoring of plates at or under 0.0002 inches per inch flatness. The non-flatness of soft cup 14 is not as critical because the total combined non-flatness of the plate and cup that can be tolerated for acceptable doctoring is approximately three times greater than doctoring with steel cups.

Statistical analysis using multivariate regression techniques demonstrate that the "Ease of Flex" of the doctoring edge has a significant impact on doctoring quality. Ease of Flex is defined as $1/(Mt^2)$; where M is the bulk or flexural modulus of the cup wall material and t is the thickness of the doctoring edge. The flexural modulus is generally in the range of about 50,000 to 1,700,000 PSI, preferably about 100,000 to 650,000 PSI. For the cup of FIG. 2, Ease of Flex values in the range of 0.020 to 0.80 $Lb^{-1}$ permit an increase in non-flatness of plate surface 13 to 0.0006 inch/inch (as compared to 0.0002 inch/inch with conventional cups) while maintaining the doctoring quality. Neither the edge thickness nor the modulus of the material, when considered alone, has been found to have a significant effect on the doctoring quality.

The following table show the modula and edge thicknesses of selected doctoring ink cups:

| | M ($10^6$ psi) | t (in) | Ease of Flex ($lb^{-1}$) |
|---|---|---|---|
| Plastic | .05 | .005 | .80000 |
| Plastic | .05 | .030 | .02222 |
| Plastic | 1.7 | .005 | .02353 |
| Plastic | 1.7 | .030 | .00065 |
| Steel | 23.6 | .005 | .00169 |
| Steel | 23.6 | .030 | .00005 |
| Brass | 15.7 | .005 | .00255 |
| Brass | 15.7 | .030 | .00007 |
| Carbide | 97.5 | .005 | .00041 |
| Carbide | 97.5 | .030 | .00001 |

Steel, cemented carbide, and ceramic cups generally operate in the 0.00001 to 0.002 $lb^{-1}$ range allowing acceptable doctoring only in the 0.0000 to 0.0002 inches/inch flatness range. No standard rigid materials result in an Ease of Flex parameter in the acceptable range for doctoring non-flat plates as determined for the cup of FIG. 2.

The following test procedure was used to determine the correlation between plate flatness, doctoring force, edge width, modulus and doctoring quality for the cup of FIG. 2.

1. Print a minimum of 5 prints for each combination of doctoring cup and printing plate on white copy paper (see appendix A for a list of doctoring cups and plates tested, various combinations of material modulus, edge thickness, doctoring force, and plate flatness were printed). The printing plates do not include an etched image such that high quality doctoring results in no transfer of ink from the plate to the paper. A special Quicklase™ gravure plate adapter (described below) was designed to allow the plates to be precisely adjusted out of flat in the print area.

2. Perform an 18 pixel scan for reflected density on the last print of each test. Perform a control scan for each test to determine the background density (the reflected density of the plain paper) for later normalization of the density readings.
3. Compute the Normal Total of the 18 density readings per test by subtracting out the control reading for each pixel to normalize the readings and total the normalized readings.
4. Perform residual analysis to isolate outliers to check for faulty data entry. Perform analysis of the data using multivariate regression to determine statistical validity of the variables. Perform scatter diagram analysis to look for relationships among the variables. Perform error analysis to determine effect on the statistical model. (See Appendix A for resulting test data.)

Figure 3:
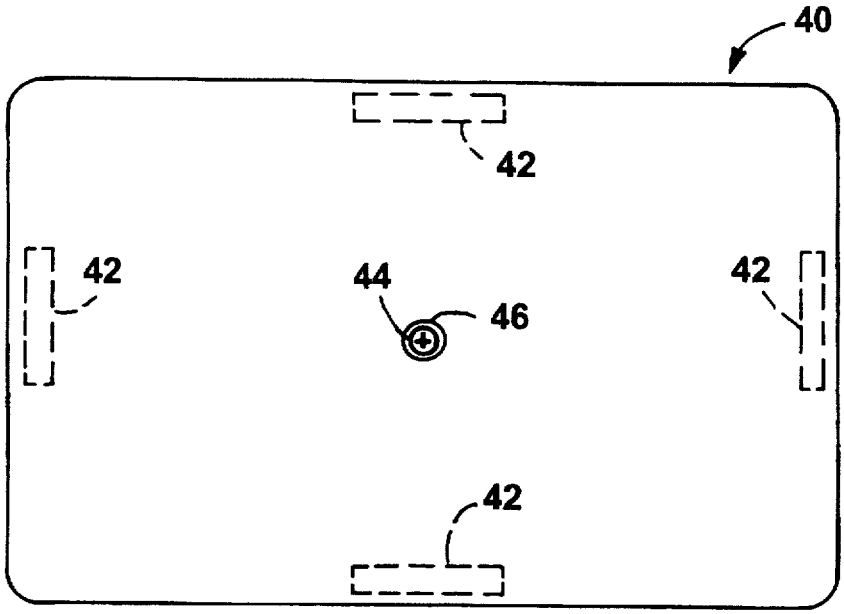
FIG. 3 is a top view of a gravure plate adapter of the invention.

Referring to FIG. 3, the special gravure plate adapter referred to in step 1 is a very flat aluminum plate 40, e.g., less than 0.00005 inches/inch, of the same size as the gravure plate to be run. Magnets 42 are embedded along the sides of the aluminum plate to hold the gravure plate to the adapter plate. A set screw 44 is mounted in a through hole 46 in the adapter in a position corresponding to the center of the print area of the gravure plate. The set screw can be adjusted to bend the plate in the center of the print area; appropriate flatness measuring equipment can be used to a measure the plates non-flatness. The gravure plate and adapter plate assembly are loaded into a printing machine to perform the testing.

All regression analyses was done with the following model:

$$Y=m_1X_1+m_2X_2+\ldots m_iX_i+b$$

where $m_i$ are the equation coefficients, $X_i$ are the variables (plate flatness, edge width, etc.) and Y is doctoring quality (normal total reflective density). All critical statistical values were based on a confidence interval of 95%.

As shown in Table 1, fitting the model with all variables and all cups tested resulted in a statistically significant model with t test for the edge width being fairly weak and a loose correlation coefficient for the whole model.

TABLE 1

| Variable | Plate Flatness ($X_1$) | Doctoring Force ($X_2$) | Edge Width ($X_3$) | Modulus ($X_4$) |
|---|---|---|---|---|
| $m_i$ | 2931.663 | .118 | 90.535 | .048 |
| $t_{calc}$ | 11.864 | 4.269 | 1.728 | 2.081 |
| $t_{crit}$ | 1.645 | 1.645 | 1.645 | 1.645 |
| $\lvert t_{calc}\rvert>t_{crit}$ | Yes | Yes | Yes | Yes |
| $F_{calc}$ | 40.15 | N/A | N/A | N/A |
| $F_{crit}$ | 2.60 | N/A | N/A | N/A |
| $F_{calc}>F_{crit}$ | Yes | N/A | N/A | N/A |
| $r^2$ | .487 | N/A | N/A | N/A |

As shown in Table 2, fitting the model while excluding all the data associated with the steel constructed doctoring ink cups yields different statistics. The overall fit of the model deteriorates and the modulus becomes statistically insignificant while the edge width remains weakly significant.

TABLE 2

| Variable | Plate Flatness ($X_1$) | Doctoring Force ($X_2$) | Edge Width ($X_3$) | Modulus ($X_4$) |
|---|---|---|---|---|
| $m_i$ | 2831.327 | .119 | 90.535 | .187 |
| $t_{calc}$ | 11.865 | 4.269 | 1.789 | .184 |
| $t_{crit}$ | 1.645 | 1.645 | 1.645 | 1.645 |
| $\|t_{calc}\|>t_{crit}$ | Yes | Yes | Yes | No |
| $F_{calc}$ | 29.84 | N/A | N/A | N/A |
| $F_{crit}$ | 2.60 | N/A | N/A | N/A |
| $F_{calc}>F_{crit}$ | Yes | N/A | N/A | N/A |
| $r^2$ | .445 | N/A | N/A | N/A |

Figure 4:
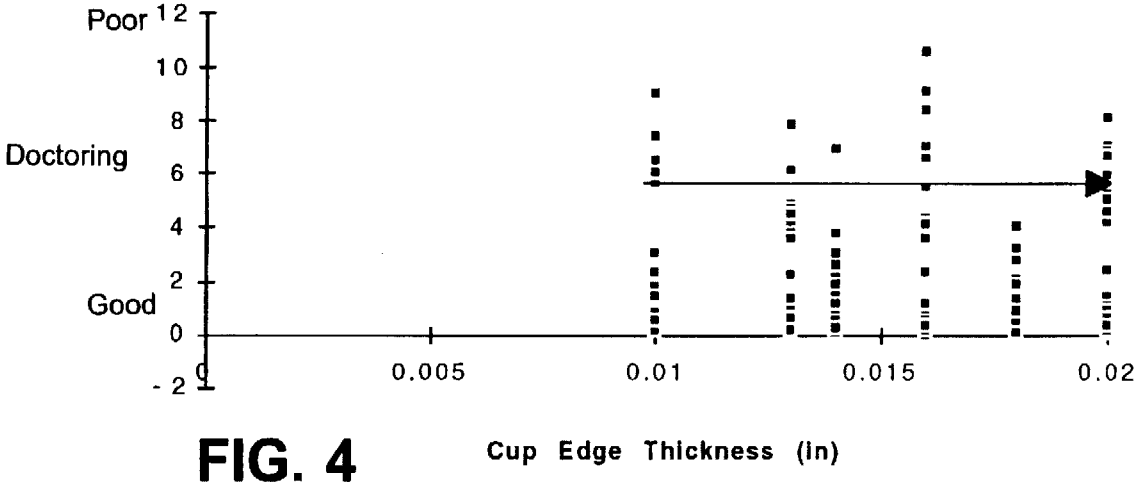
FIG. 4 is a graph of the dependence of doctoring quality on edge thickness.

As shown in Table 3 and FIG. 4, fitting the model for all cups tested without including the modulus resulted in a statistically worse fit for the edge width such that edge width became insignificant. Thus, no clear trend to better quality occurs with varying edge width.

TABLE 3

| Variable | Plate Flatness ($X_1$) | Doctoring Force ($X_2$) | Edge Width ($X_3$) | Modulus ($X_4$) |
|---|---|---|---|---|
| $m_i$ | 2926.476 | .115 | 25.068 | N/A |
| $t_{calc}$ | 11.730 | 4.122 | .592 | N/A |
| $t_{crit}$ | 1.645 | 1.645 | 1.645 | N/A |
| $\|t_{calc}\|>t_{crit}$ | Yes | Yes | No | N/A |
| $F_{calc}$ | 51.10 | N/A | N/A | N/A |
| $F_{crit}$ | 2.60 | N/A | N/A | N/A |
| $F_{calc}>F_{crit}$ | Yes | N/A | N/A | N/A |
| $r^2$ | .474 | N/A | N/A | N/A |

Figure 4A:
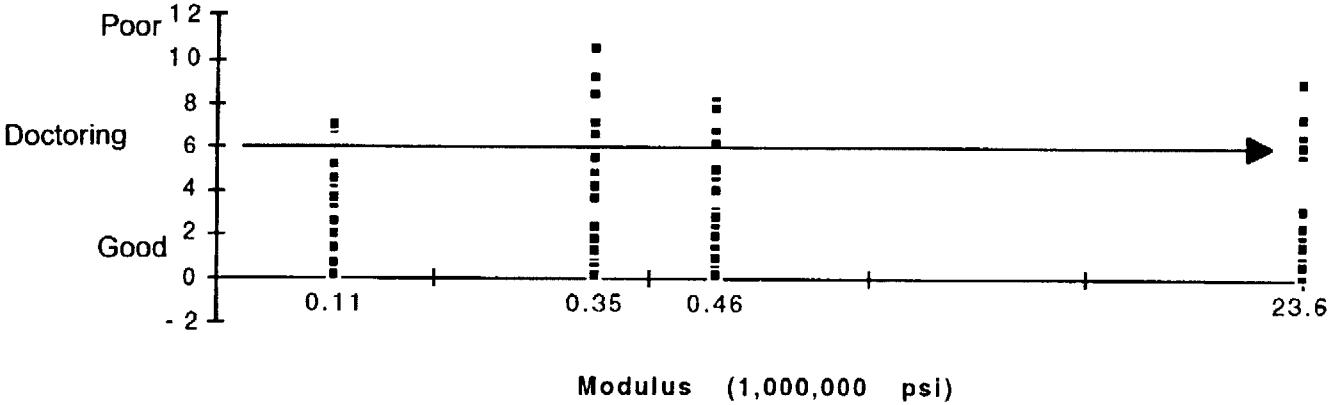
FIG. 4A is a graph of the dependence of doctoring quality on modulus.

As shown in Table 4 and FIG. 4A, fitting the model without including the edge width did not improve the significance of the modulus. Thus, no clear trend to better quality occurs with lower modulus.

TABLE 4

| Variable | Plate Flatness ($X_1$) | Doctoring Force ($X_2$) | Edge Width ($X_3$) | Modulus ($X_4$) |
|---|---|---|---|---|
| $m_i$ | 2869.777 | .115 | N/A | .024 |
| $t_{calc}$ | 11.670 | 4.124 | N/A | 1.297 |
| $t_{crit}$ | 1.645 | 1.645 | N/A | 1.645 |
| $\|t_{calc}\|>t_{crit}$ | Yes | Yes | N/A | No |
| $F_{calc}$ | 51.94 | N/A | N/A | N/A |
| $F_{crit}$ | 2.60 | N/A | N/A | N/A |
| $F_{calc}>F_{crit}$ | Yes | N/A | N/A | N/A |
| $r^2$ | .478 | N/A | N/A | N/A |

Figure 4B:
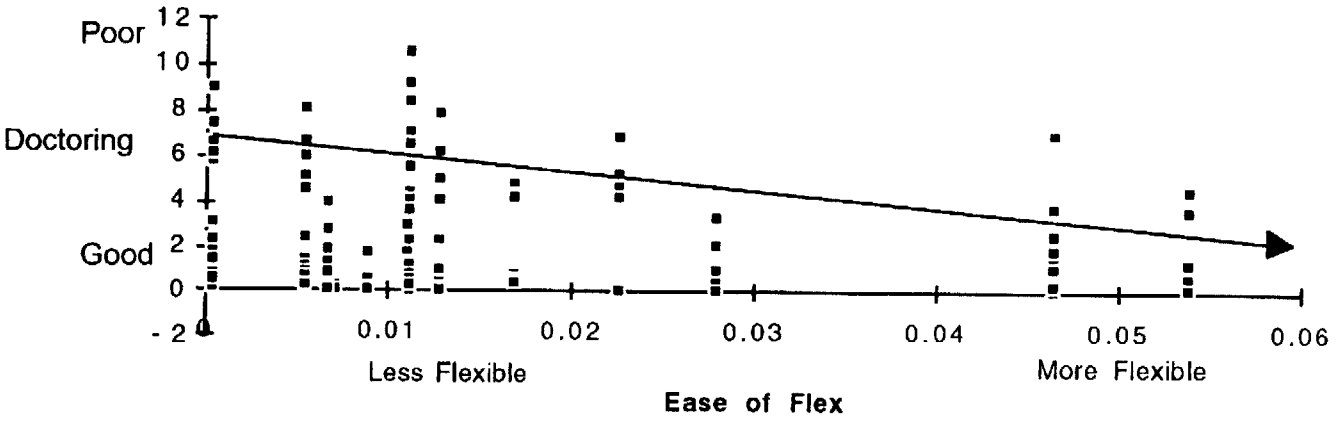
FIG. 4B is a graph of the dependence of doctoring quality on Ease of Flex.

A good statistical fit was obtained using the "Ease of Flex" parameter ($1/(Mt^2)$). As shown in Table 5 and FIG. 4B, fitting the model with ease of flex reveals a good statistical significance for all critical values. Thus, a trend toward better doctoring occurs as the ease of flex increases.

TABLE 5

| Variable | Plate Flatness ($X_1$) | Doctoring Force ($X_2$) | Ease Flex ($X_3$) |
|---|---|---|---|
| $m_i$ | 2917.901 | .117 | 20.561 |
| $t_{calc}$ | 12.046 | 4.234 | 2.324 |
| $t_{crit}$ | 1.645 | 1.645 | 1.645 |
| $\|t_{calc}\|>t_{crit}$ | Yes | Yes | Yes |
| $F_{calc}$ | 54.30 | N/A | N/A |
| $F_{crit}$ | 2.60 | N/A | N/A |
| $F_{calc}>F_{crit}$ | Yes | N/A | N/A |
| $r^2$ | .489 | N/A | N/A |

Figure 5:
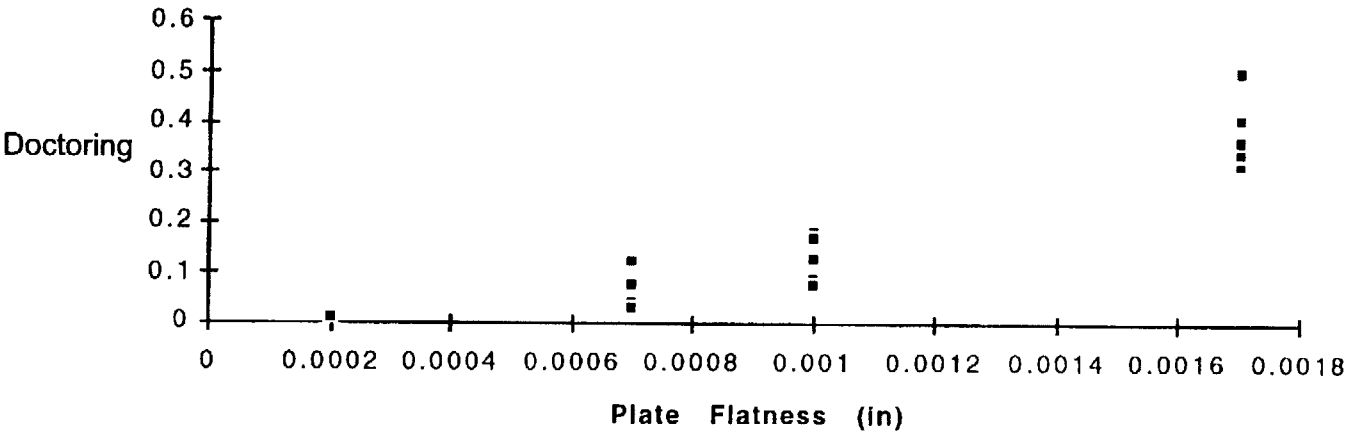
FIG. 5 is a graph of the dependence of doctoring quality on plate flatness for conventional metal cups.

Referring to FIG. 5, none of the steel cups tested exhibited acceptable doctoring in flatness ranges above 0.0005 inches (the total non-flatness of a two inch plate that is out-of-flat by 0.00025 inches per inch).

Figure 6:
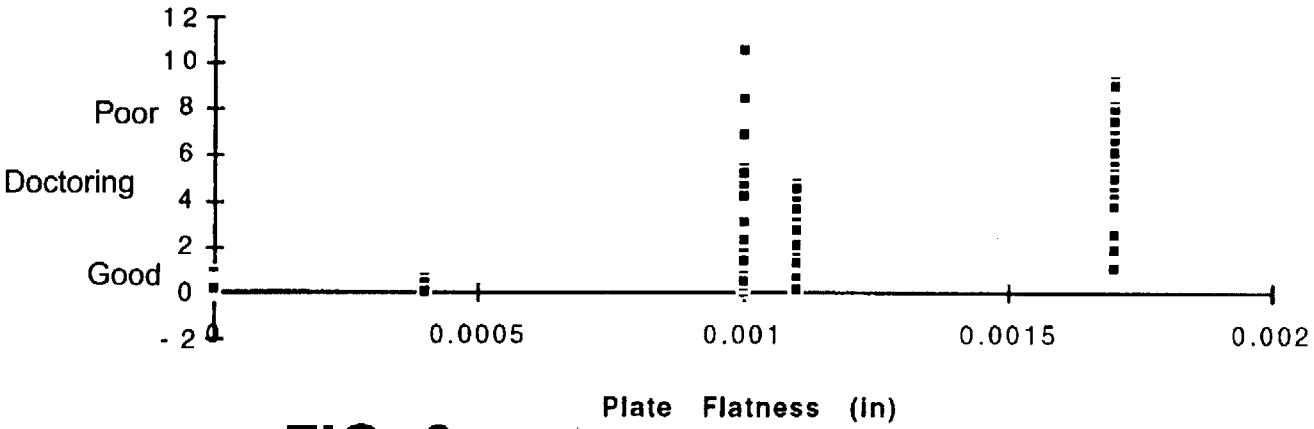
FIG. 6 is a graph of the dependence of doctoring quality on plate flatness for soft cups according to the invention.

Referring to FIG. 6, high Ease of Flex cups, e.g., cups having an Ease of Flex greater than 0.005 $lb^{-1}$, were tested which exhibited acceptable doctoring well into the 0.0012 inch total non-flatness region.

Figure 7:
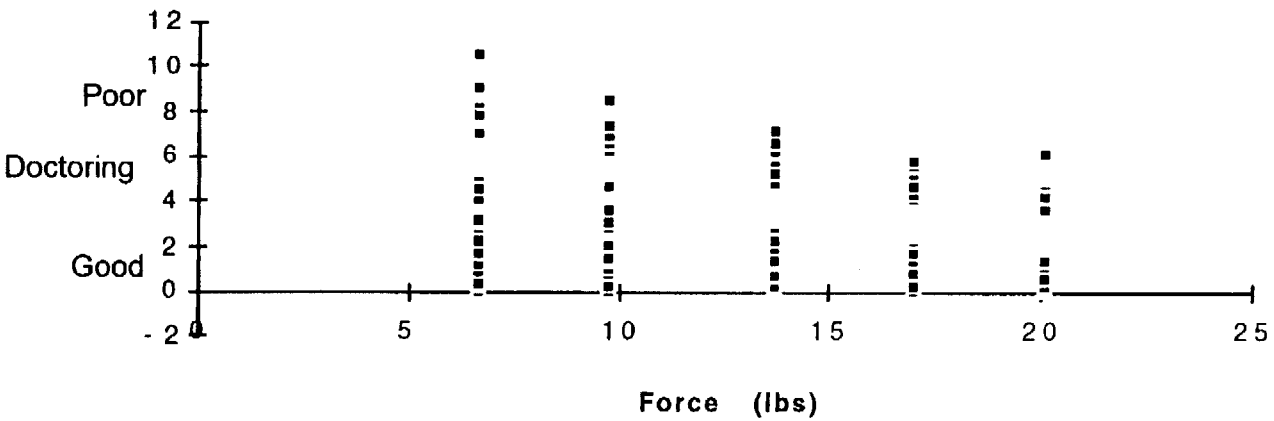
FIG. 7 is a graph of the dependence of doctoring quality on doctoring force for soft cups according to the invention.

Referring to FIG. 7, increasing doctoring force improves doctoring quality independent of the Ease of Flex.

Outlier data points can be analyzed to determine if they can be accounted for and disregarded from the analysis. The results from the above described test is summarized in the following table.

| Modulus ($10^6$ psi) | Edge Width | Plate Flatness | Analysis | Use Data? |
|---|---|---|---|---|
| .11 | .013 | .0011 | No Detectable Reason | Yes |
| .11 | .013 | .0010 | No Detectable Reason | Yes |
| .11 | .013 | .0010 | No Detectable Reason | Yes |
| .11 | .013 | .0017 | No Detectable Reason | Yes |
| .11 | .013 | .0017 | No Detectable Reason | Yes |
| .11 | .021 | .0010 | Scratches on edge, not flat | No |
| .35 | .013 | .0011 | Leakage, not flat, scratches | No |
| .35 | .015 | .0010 | Scratches one side, not flat | No |
| .35 | .015 | .0017 | Major scratches, wide strip | No |
| .35 | .018 | .0011 | No Detectable Reason | Yes |
| .46 | .014 | .0010 | No Detectable Reason | Yes |
| .46 | .018 | .0010 | No Detectable Reason | Yes |
| .46 | .018 | .0017 | No Detectable Reason | Yes |
| 23.6 | .010 | .0017 | No Detectable Reason | Yes |

The elimination of the suspect data results in a better fit for the regression model. The following is the result of the regression model when deleting this data.

$F=96$ $t_{calc\ (flatness)}=16.2$ $t_{calc\ (force)}=5.12$ $t_{calc\ (flex)}=4.13$ $r^2=0.658$ The "soft" doctoring cups are particularly suited for doctoring non-flat plates. Ink cups can thus be optimally designed by taking into account the type and quality of the printing plate.

Dimensional parameters of the cup other than the edge thickness, for example, cup diameter $D_1$ and the thickness and shape of edge wall section 22, influence the doctoring performance of the ink cup. The diameter and wall parameters are usually dictated by the size of the legend that must be doctored, machine constraints of the printer, and desired ink cup volume. Given the constraints of the printing system, the ink cup design can be optimized by selecting an edge thickness t and flexural modulus M of the cup that provide satisfactory doctoring for a given plate flatness. The procedure described above can be used to determined an acceptable range of Ease of Flex for doctoring non-flat plates for a given cup geometry. Any material, e.g., plastics such as delrin, nylon and polyethylene and wood, that has a modulus and edge thickness resulting in an Ease of Flex value needed for doctoring non-flat plates can be used.

Other embodiments are within the scope of the following claims.

APPENDIX A

| Cup Material | Modulus Million psi | Edge | Ease of Flexture | Force | Plate Flatness | Normal Total | 1 | 2 | 3 | 4 | 5 | 6 | 7 | 8 | 9 | 10 | 11 | 12 | 13 | 14 | 15 | 16 | 17 | 18 | Base |
|---|---|---|---|---|---|---|---|---|---|---|---|---|---|---|---|---|---|---|---|---|---|---|---|---|---|
| Delrin | 0.46 | .020 | .0054 | 6.700 | .0000 | .790 | .14 | .18 | .14 | .16 | .14 | .14 | .14 | .19 | .20 | .22 | .17 | .15 | .17 | .17 | .21 | .14 | .29 | .18 | .13 |
| Delrin | 0.46 | .013 | .0129 | 6.700 | .0000 | .130 | .14 | .13 | .12 | .17 | .15 | .15 | .13 | .14 | .13 | .13 | .13 | .13 | .13 | .14 | .13 | .16 | .13 | .13 | .13 |
| Delrin | 0.46 | .020 | .0054 | 9.800 | .0000 | .470 | .15 | .13 | .14 | .15 | .14 | .14 | .14 | .16 | .18 | .13 | .16 | .14 | .21 | .14 | .19 | .13 | .21 | .17 | .13 |
| Delrin | 0.46 | .013 | .0129 | 9.800 | .0000 | .120 | .13 | .13 | .13 | .14 | .14 | .13 | .13 | .19 | .14 | .13 | .13 | .14 | .13 | .14 | .14 | .13 | .13 | .13 | .13 |
| Delrin | 0.46 | .020 | .0054 | 13.700 | .0000 | .380 | .14 | .15 | .14 | .14 | .14 | .14 | .14 | .15 | .14 | .17 | .14 | .14 | .18 | .14 | .18 | .14 | .20 | .15 | .13 |
| Delrin | 0.46 | .013 | .0129 | 13.700 | .0000 | .130 | .13 | .13 | .14 | .14 | .14 | .14 | .13 | .15 | .14 | .14 | .13 | .14 | .13 | .14 | .13 | .14 | .14 | .14 | .13 |
| Delrin | 0.46 | .020 | .0054 | 17.000 | .0000 | .330 | .14 | .13 | .14 | .14 | .13 | .14 | .14 | .13 | .14 | .14 | .14 | .16 | .21 | .14 | .16 | .14 | .19 | .16 | .13 |
| Delrin | 0.46 | .020 | .0054 | 20.100 | .0000 | .340 | .14 | .15 | .13 | .14 | .13 | .13 | .14 | .13 | .14 | 14 | 14 | .14 | .18 | .14 | .18 | .14 | .24 | .15 | .13 |
| Delrin | 0.46 | .020 | .0054 | 6.700 | .0010 | 2.450 | .13 | .15 | .15 | .19 | .13 | .51 | .22 | 1.01 | .52 | .29 | .15 | .16 | .34 | .27 | .23 | .17 | .19 | .16 | .14 |
| Delrin | 0.46 | .020 | .0054 | 6.700 | .0010 | .120 | .14 | .14 | .14 | .13 | .14 | .14 | .13 | .28 | .13 | .13 | .14 | .14 | .15 | .13 | .16 | .14 | .14 | .14 | .14 |
| Delrin | 0.46 | .020 | .0054 | 9.800 | .0010 | 1.430 | .14 | .14 | .14 | .20 | .14 | .38 | .16 | .90 | .33 | .25 | .13 | .14 | .18 | .15 | .14 | .15 | .14 | .14 | .14 |
| Delrin | 0.46 | .020 | .0054 | 9.800 | .0010 | .120 | .14 | .13 | .13 | .14 | .13 | .14 | .13 | .13 | .14 | .13 | .14 | .13 | .14 | .14 | .17 | .13 | .13 | .14 | .13 |
| Delrin | 0.46 | .020 | .0054 | 13.700 | .0010 | 1.070 | .14 | .13 | .14 | .14 | .15 | .27 | .16 | .77 | .18 | .19 | .14 | .14 | .15 | .14 | .14 | .14 | .14 | .15 | .13 |
| Delrin | 0.46 | .020 | .0054 | 13.700 | .0010 | .110 | .14 | .13 | .13 | .14 | .13 | .14 | .13 | .15 | .13 | .13 | .13 | .13 | .16 | .13 | .15 | .13 | .14 | .13 | .13 |
| Delrin | 0.46 | .020 | .0054 | 17.000 | .0010 | .860 | .13 | .14 | .14 | .16 | .14 | .18 | .14 | .66 | .19 | .21 | .13 | .14 | .14 | .14 | .14 | .14 | .14 | .14 | .13 |
| Delrin | 0.46 | .020 | .0054 | 17.000 | .0010 | .160 | .14 | .13 | .13 | .13 | .14 | .13 | .12 | .13 | .13 | .12 | .13 | .13 | .21 | .14 | .17 | .14 | .13 | .15 | .13 |
| Delrin | 0.46 | .020 | .0054 | 20.100 | .0010 | .610 | .14 | .14 | .16 | .19 | .14 | .15 | .15 | .54 | .21 | .19 | .15 | .14 | .13 | .14 | .13 | .15 | .14 | .14 | .14 |
| Delrin | 0.46 | .020 | .0054 | 20.100 | .0010 | .290 | .14 | .13 | .13 | .14 | .13 | .14 | .14 | .13 | .14 | .13 | .13 | .14 | .15 | .13 | .14 | .14 | .14 | .13 | .12 |
| Delrin | 0.46 | .014 | .0111 | 6.700 | .0010 | 3.000 | .14 | .13 | .14 | .12 | .13 | .15 | .13 | .57 | .13 | .13 | .11 | .17 | 1.11 | .52 | 1.14 | .16 | .19 | .14 | .13 |
| Delrin | 0.46 | .014 | .0111 | 9.800 | .0010 | 2.120 | .13 | .13 | .14 | .13 | .13 | .14 | .13 | .14 | .13 | .12 | .14 | .14 | 1.06 | .28 | 1.10 | .14 | .14 | .14 | .13 |
| Delrin | 0.46 | .014 | .0111 | 13.700 | .0010 | 2.200 | .13 | .13 | .13 | .13 | .13 | .14 | .14 | .15 | .14 | .13 | .14 | .13 | 1.01 | .26 | 1.05 | .14 | .15 | .13 | .12 |
| Delrin | 0.46 | .014 | .0111 | 17.000 | .0010 | 1.880 | .13 | .14 | .13 | .13 | .14 | .13 | .13 | .14 | .13 | .13 | .13 | .14 | .93 | .15 | .95 | .14 | .14 | .13 | .12 |
| Delrin | 0.46 | .014 | .0111 | 20.100 | .0010 | .790 | .13 | .13 | .14 | .13 | .13 | .14 | .15 | .13 | .13 | .14 | .13 | .13 | .58 | .14 | .39 | .14 | .13 | .14 | .13 |
| Delrin | 0.46 | .013 | .0129 | 6.700 | .0010 | 2.260 | .14 | .14 | .46 | .14 | .23 | .60 | .52 | .59 | .14 | .24 | .14 | .24 | .22 | .14 | .20 | .14 | .18 | .14 | .13 |
| Delrin | 0.46 | .013 | .0129 | 6.700 | .0010 | 1.170 | .13 | .13 | .14 | .14 | .14 | .42 | .14 | .50 | .14 | .13 | .13 | .16 | .23 | .16 | .27 | .14 | .27 | .14 | .13 |
| Delrin | 0.46 | .013 | .0129 | 9.800 | .0010 | 1.060 | .14 | .14 | .15 | .14 | .14 | .43 | .31 | .23 | .14 | .44 | .14 | .14 | .16 | .13 | .14 | .14 | .15 | .14 | .13 |
| Delrin | 0.46 | .013 | .0129 | 9.800 | .0010 | .170 | .13 | .14 | .13 | .13 | .13 | .23 | .13 | .15 | .13 | .13 | .13 | .13 | .14 | .13 | .14 | .13 | .13 | .15 | .13 |
| Delrin | 0.46 | .013 | .0129 | 13.700 | .0010 | .510 | .14 | .14 | .14 | .13 | .14 | .32 | .29 | .18 | .14 | .32 | .13 | .14 | .14 | .13 | .14 | .13 | .14 | .14 | .14 |
| Delrin | 0.46 | .013 | .0129 | 13.700 | .0010 | .140 | .14 | .13 | .14 | .13 | .13 | .15 | .14 | .14 | .14 | .14 | .14 | .14 | .14 | .13 | .13 | .14 | .14 | .14 | .13 |
| Delrin | 0.46 | .013 | .0129 | 17.000 | .0010 | .050 | .14 | .14 | .14 | .13 | .13 | .13 | .13 | .25 | .15 | .13 | .14 | .15 | .13 | .13 | .13 | .14 | .14 | .14 | .14 |
| Delrin | 0.46 | .013 | .0129 | 20.100 | .0010 | .170 | .13 | .14 | .13 | .14 | .13 | .14 | .13 | .18 | .14 | .14 | .13 | .13 | .14 | .14 | .14 | .14 | .14 | .15 | .13 |
| Delrin | 0.46 | .020 | .0054 | 6.700 | .0017 | 8.130 | .13 | .13 | .19 | .15 | .66 | 1.23 | 1.09 | 1.20 | 1.05 | .13 | .14 | .13 | 1.17 | .89 | 1.18 | .67 | .19 | .14 | .13 |
| Delrin | 0.46 | .020 | .0054 | 9.800 | .0017 | 6.700 | .13 | .13 | .13 | .14 | .43 | 1.19 | .19 | 1.23 | 1.01 | .13 | .13 | .13 | 1.10 | .71 | 1.13 | .24 | .15 | .14 | .13 |
| Delrin | 0.46 | .020 | .0054 | 13.700 | .0017 | 5.980 | .13 | .13 | .13 | .13 | .32 | 1.13 | .65 | 1.23 | .89 | .14 | .14 | .14 | 1.08 | .56 | 1.09 | .16 | .14 | .13 | .13 |
| Delrin | 0.46 | .020 | .0054 | 17.000 | .0017 | 5.080 | .14 | .14 | .13 | .14 | .14 | 1.08 | .44 | 1.18 | .48 | .13 | .13 | .15 | 1.08 | .62 | 1.04 | .14 | .13 | .13 | .13 |
| Delrin | 0.46 | .020 | .0054 | 20.100 | .0017 | 4.550 | .14 | .14 | .13 | .14 | .13 | 1.12 | .18 | 1.19 | .31 | .12 | .13 | .13 | 1.05 | .41 | .99 | .13 | .14 | .13 | .12 |
| Delrin | 0.46 | .013 | .0129 | 6.700 | .0017 | 7.820 | .13 | .13 | .14 | .21 | .14 | 1.10 | .49 | 1.17 | .71 | .13 | .38 | .18 | 1.24 | 1.17 | 1.24 | .81 | .64 | .15 | .13 |
| Delrin | 0.46 | .013 | .0129 | 9.800 | .0017 | 6.240 | .13 | .13 | .14 | .14 | .14 | 1.05 | .31 | 1.13 | .44 | .12 | .22 | .13 | 1.23 | 1.15 | 1.21 | .47 | .31 | .13 | .13 |
| Delrin | 0.48 | .013 | .0129 | 13.700 | .0017 | 6.150 | .14 | .13 | .14 | .13 | .13 | .47 | .47 | 1.01 | .63 | .13 | .13 | .13 | 1.23 | 1.09 | 1.23 | .77 | .39 | .14 | .13 |
| Delrin | 0.46 | .013 | .0129 | 17.000 | .0017 | 4.980 | .14 | .13 | .13 | .14 | .13 | .81 | .14 | 1.10 | .18 | .13 | .15 | .14 | 1.23 | 1.02 | 1.16 | .30 | .16 | .13 | .13 |
| Delrin | 0.46 | .013 | .0129 | 20.100 | .0017 | 4.060 | .13 | .13 | .12 | .13 | .14 | .52 | .13 | 1.06 | .13 | .13 | .13 | .14 | 1.17 | .81 | 1.13 | .13 | .14 | .13 | .13 |
| Delrin | 0.46 | .013 | .0129 | 6.700 | .0004 | .000 | .14 | .14 | .14 | .14 | .14 | .14 | .14 | .14 | .14 | .14 | .14 | .14 | .14 | .14 | .14 | .14 | .14 | .14 | .14 |
| Delrin | 0.46 | .013 | .0129 | 9.800 | .0004 | .000 | .14 | .14 | .14 | .14 | .14 | .14 | .14 | .14 | .14 | .14 | .14 | .14 | .14 | .14 | .14 | .14 | .14 | .14 | .14 |
| Delrin | 0.46 | .018 | .0067 | 6.700 | .0004 | .150 | .15 | .18 | .14 | .14 | .15 | .14 | .15 | .14 | .14 | .17 | .14 | .14 | .15 | .14 | .14 | .17 | .14 | .15 | .14 |
| Delrin | 0.46 | .018 | .0067 | 9.800 | .0004 | .040 | .14 | .14 | .14 | .15 | .14 | .14 | .15 | .14 | .15 | .14 | .14 | .14 | .14 | .14 | .15 | .14 | .14 | .14 | .14 |
| Delrin | 0.46 | .018 | .0067 | 13.700 | .0004 | .010 | .14 | .14 | .15 | .14 | .14 | .14 | .14 | .14 | .14 | .14 | .14 | .14 | .14 | .14 | .14 | .14 | .14 | .14 | .14 |
| Delrin | 0.46 | .018 | .0067 | 17.000 | .0004 | .000 | .14 | .14 | .14 | .14 | .14 | .14 | .14 | .14 | .14 | .14 | .14 | .14 | .14 | .14 | .14 | .14 | .14 | .14 | .14 |
| Delrin | 0.46 | .018 | .0067 | 17.000 | .0004 | .000 | .14 | .14 | .14 | .14 | .14 | .14 | .14 | .14 | .14 | .14 | .14 | .14 | .14 | .14 | .14 | .14 | .14 | .14 | 14 |

APPENDIX A-continued

| Cup Material | Modulus Million psi | Edge | Ease of Flexture | Force | Plate Flatness | Normal Total | 1 | 2 | 3 | 4 | 5 | 6 | 7 | 8 | 9 | 10 | 11 | 12 | 13 | 14 | 15 | 16 | 17 | 18 | Base |
|---|---|---|---|---|---|---|---|---|---|---|---|---|---|---|---|---|---|---|---|---|---|---|---|---|---|
| Delrin | 0.46 | .013 | .0129 | 6.700 | .0011 | .910 | .13 | .13 | .13 | .13 | .14 | .14 | .19 | .13 | .50 | .13 | .13 | .14 | .14 | .14 | .13 | .14 | .54 | .14 | .13 |
| Delrin | 0.46 | .013 | .0129 | 9.800 | .0011 | .080 | .14 | .14 | .13 | .14 | .14 | .13 | .14 | .13 | .13 | .13 | .13 | .14 | .13 | .13 | .13 | .13 | .15 | .13 | .13 |
| Delrin | 0.46 | .018 | .0067 | 6.700 | .0011 | 4.000 | .13 | .13 | .14 | .14 | .14 | .13 | .99 | .33 | 1.21 | .89 | .13 | .14 | .13 | .14 | .17 | .36 | .84 | .20 | .13 |
| Delrin | 0.46 | .018 | .0067 | 9.800 | .0011 | 2.780 | .14 | .13 | .14 | .13 | .14 | .14 | .14 | .22 | 1.16 | .41 | .13 | .13 | .13 | .13 | .16 | .24 | .70 | .15 | .13 |
| Delrin | 0.46 | .018 | .0061 | 13.700 | .0011 | 1.870 | .13 | .14 | .13 | .13 | .13 | .13 | .66 | .15 | 1.11 | .13 | .13 | .13 | .14 | .13 | .14 | .14 | .43 | .13 | .13 |
| Delrin | 0.46 | .018 | .0067 | 17.000 | .0011 | 1.330 | .13 | .13 | .14 | .14 | .13 | .14 | .45 | .14 | 1.02 | .13 | .14 | .14 | .13 | .13 | .14 | .13 | .18 | .13 | .13 |
| Delrin | 0.46 | .018 | .0067 | 20.100 | .0011 | .890 | .13 | .13 | .13 | .13 | .14 | .14 | .26 | .13 | .83 | .13 | .13 | .13 | .13 | .13 | .14 | .13 | .15 | .14 | .13 |
| Nylon | 0.35 | .020 | .0071 | 6.700 | .0000 | .200 | .14 | .13 | .13 | .15 | .13 | .14 | .15 | .14 | .14 | .20 | .14 | .14 | .13 | .13 | .13 | .14 | .14 | .14 | .13 |
| Nylon | 0.35 | .016 | .0112 | 6.700 | .0000 | .380 | .14 | .13 | .15 | .19 | .14 | 15 | .14 | .22 | .20 | .14 | .14 | .14 | .15 | .15 | .14 | .13 | .14 | .13 | .13 |
| Nylon | 0.35 | .016 | .0112 | 6.700 | .0000 | .390 | .14 | .14 | .13 | .14 | .14 | .13 | .14 | .14 | .14 | .35 | .14 | .15 | .14 | .14 | .14 | .15 | .14 | .14 | .13 |
| Nylon | 0.35 | .020 | .0071 | 9.800 | .0000 | .080 | .13 | .13 | .14 | .13 | .13 | .14 | .13 | .13 | .13 | .17 | .13 | .13 | .14 | .13 | .14 | .13 | .13 | .13 | .13 |
| Nylon | 0.35 | .016 | .0112 | 9.800 | .0000 | .280 | .14 | .13 | .13 | .15 | .14 | .14 | .13 | .16 | .17 | .19 | .13 | .15 | .14 | .15 | .15 | .14 | .14 | .14 | .13 |
| Nylon | 0.35 | .016 | .0112 | 9.800 | .0000 | .410 | .14 | .14 | .13 | .14 | .14 | .14 | .13 | .13 | .17 | .40 | .14 | .14 | .14 | .15 | .13 | .13 | .13 | .13 | .13 |
| Nylon | 0.35 | .020 | .0071 | 13.700 | .0000 | .080 | .14 | .13 | .14 | .14 | .13 | .13 | .14 | .13 | .13 | .16 | .13 | .13 | .13 | .13 | .14 | .13 | .13 | .13 | .13 |
| Nylon | 0.35 | .016 | 0112 | 13.700 | .0000 | .030 | .13 | .13 | .13 | .14 | .13 | .13 | .13 | .17 | .14 | .17 | .13 | .14 | .13 | .13 | .13 | .14 | .15 | .14 | 14 |
| Nylon | 0.35 | .016 | .0112 | 13.700 | .0000 | .250 | .14 | .13 | .13 | .13 | .14 | .14 | .14 | .13 | .15 | .29 | .13 | .13 | .14 | .14 | .13 | .13 | .13 | .14 | .13 |
| Nylon | 0.35 | .020 | .0071 | 17.000 | .0000 | .230 | .14 | .13 | .13 | .13 | .13 | .14 | .13 | .13 | .13 | .15 | .14 | .13 | .13 | .13 | .13 | .14 | .13 | .12 | .12 |
| Nylon | 0.35 | .016 | .0112 | 17.000 | .0000 | .160 | .13 | .13 | .14 | .15 | .14 | .14 | .13 | .14 | .15 | .16 | .13 | .13 | .13 | .14 | .14 | .14 | .14 | .14 | .13 |
| Nylon | 0.35 | .016 | .0112 | 17.000 | .0000 | .180 | .13 | .14 | .13 | .14 | .13 | .13 | .13 | .13 | .13 | .25 | .13 | .13 | .14 | .14 | .13 | .14 | .13 | .14 | .13 |
| Nylon | 0.35 | .020 | .0071 | 20.100 | .0000 | .070 | .13 | .13 | .14 | .14 | .13 | .15 | .13 | .13 | .14 | .13 | .13 | .14 | .14 | .13 | .13 | .12 | .13 | .14 | .13 |
| Nylon | 0.35 | .016 | .0112 | 20.100 | .0000 | .230 | .13 | .13 | .13 | .18 | .14 | .15 | .14 | .15 | .16 | .15 | .14 | .14 | .14 | .14 | .14 | .14 | .14 | .13 | .13 |
| Nylon | 0.35 | .016 | .0112 | 20.100 | .0000 | .160 | .14 | .13 | .14 | .13 | .12 | .14 | .13 | .14 | .13 | .18 | .13 | .14 | .14 | .15 | .14 | .14 | .14 | .14 | .13 |
| Nylon | 0.35 | .016 | .0112 | 6.700 | .0010 | 1.220 | .13 | .13 | .13 | .25 | .13 | .17 | .13 | .89 | .30 | .13 | .14 | .14 | .17 | .13 | .16 | .14 | .15 | .14 | .13 |
| Nylon | 0.35 | .016 | .0112 | 6.700 | .0010 | 10.550 | .16 | .14 | .91 | 1.12 | .63 | 1.19 | 1.12 | 1.21 | 1.22 | .84 | .18 | .26 | 1.08 | .14 | 1.13 | .25 | .50 | .15 | .13 |
| Nylon | 0.35 | .016 | .0112 | 6.700 | .0010 | 2.280 | .14 | .14 | .18 | .24 | .15 | .46 | .32 | .65 | .14 | .21 | .11 | .56 | .30 | .14 | .26 | .15 | .28 | .13 | .13 |
| Nylon | 0.35 | .016 | .0112 | 9.800 | .0010 | .810 | .13 | .14 | .14 | .13 | .14 | .13 | .14 | .61 | .14 | .15 | .14 | .14 | .14 | .14 | .14 | .13 | .16 | .13 | .12 |
| Nylon | 0.35 | .016 | .0112 | 9.800 | .0010 | 8.420 | .14 | .13 | .37 | .96 | .21 | .99 | .46 | 1.18 | 1.10 | .42 | .14 | .16 | 1.11 | .87 | 1.12 | .49 | .68 | .23 | .13 |
| Nylon | 0.35 | .016 | .0112 | 9.800 | .0010 | 1.180 | .13 | .13 | .16 | .19 | .14 | .28 | .16 | .58 | .14 | .15 | .15 | .30 | .23 | .14 | .21 | .13 | .16 | .14 | .13 |
| Nylon | 0.35 | .016 | .0112 | 13.700 | .0010 | .270 | .13 | .13 | .13 | .14 | .14 | .14 | .13 | .29 | .14 | .14 | .13 | .13 | .13 | .14 | .15 | .14 | .15 | .13 | .13 |
| Nylon | 0.35 | .016 | .0112 | 13.700 | .0010 | 7.080 | .14 | .14 | .29 | .79 | .19 | .12 | .18 | 1.14 | 1.02 | .28 | .13 | .14 | 1.07 | .77 | 1.08 | .50 | .54 | .30 | .13 |
| Nylon | 0.35 | .016 | .0112 | 13.700 | .0010 | .710 | .13 | .13 | .14 | .11 | .13 | .20 | .14 | .52 | .14 | .14 | .13 | .20 | .17 | .14 | .15 | .14 | .15 | .13 | .13 |
| Nylon | 0.35 | .016 | .0112 | 17.000 | .0010 | .100 | .14 | .13 | .14 | .14 | .14 | .13 | .13 | .14 | .13 | .13 | .13 | .13 | .13 | .13 | .14 | .14 | .15 | .14 | .13 |
| Nylon | 0.35 | .016 | .0112 | 11.000 | .0010 | 5.470 | .13 | .13 | .22 | .69 | .17 | .45 | .14 | 1.13 | .93 | .17 | .14 | .14 | 1.01 | .61 | .98 | .17 | .23 | .19 | 12 |
| Nylon | 0.35 | .016 | .0112 | 17.000 | .0010 | .460 | .14 | .13 | .13 | .15 | .14 | .16 | .14 | .35 | .14 | .14 | .14 | .15 | .18 | .13 | .14 | .14 | .16 | .14 | .13 |
| Nylon | 0.35 | .016 | .0112 | 20.100 | .0010 | .110 | .13 | .13 | .14 | .13 | .14 | .14 | .13 | .14 | .14 | .14 | .14 | .14 | .13 | .14 | .13 | .14 | .14 | .13 | .13 |
| Nylon | 0.35 | .016 | .0112 | 20.100 | .0010 | 4.360 | .13 | .13 | .23 | .89 | .15 | .35 | .14 | 1.07 | .73 | .13 | .13 | .13 | .93 | .32 | .87 | .14 | .26 | .11 | .13 |
| Nylon | 0.35 | .016 | .0112 | 20.100 | .0010 | .280 | .13 | .14 | .14 | .15 | .13 | .15 | .13 | .29 | .13 | .13 | .13 | .14 | .14 | .14 | .15 | .13 | .14 | .13 | .13 |
| Nylon | 0.35 | .016 | .0112 | 6.700 | .0017 | 9.160 | .23 | .43 | .18 | .18 | .18 | 1.06 | .36 | 1.13 | .55 | .21 | .27 | .59 | 1.24 | 1.22 | 1.27 | .95 | 1.11 | .34 | .13 |
| Nylon | 0.35 | .016 | .0112 | 9.800 | .0017 | 6.570 | .15 | .28 | .16 | .16 | .14 | .66 | .19 | .92 | .29 | .15 | .15 | .36 | 1.27 | 1.21 | 1.28 | .51 | 1.01 | .14 | .14 |
| Nylon | 0.35 | .016 | .0112 | 13.700 | .0017 | 5.534 | .14 | .22 | .14 | .14 | .14 | .35 | .14 | .51 | .14 | .14 | .11 | .30 | 1.25 | 1.15 | 1.27 | .49 | .89 | .17 | .12 |
| Nylon | 0.35 | .016 | .0112 | 17.000 | .0017 | 4.090 | .13 | .22 | .14 | .13 | .14 | .18 | .15 | .24 | .13 | .13 | .14 | .21 | 1.24 | 1.09 | 1.23 | .30 | .66 | .15 | .14 |
| Nylon | 0.35 | .016 | .0112 | 20.100 | .0017 | 3.630 | .13 | .17 | .13 | .14 | .14 | .15 | .14 | .15 | .13 | .13 | .13 | .19 | 1.24 | .87 | 1.21 | .31 | .47 | .14 | .13 |
| Nylon | 0.35 | .013 | .0169 | 6.700 | .0004 | .680 | .13 | .15 | .14 | .14 | .14 | .15 | .11 | .47 | .15 | .15 | .14 | .15 | .15 | .15 | .20 | .15 | .32 | .15 | .14 |
| Nylon | 0.35 | .013 | .0169 | 9.800 | .0004 | .470 | .14 | .16 | .14 | .14 | .14 | .15 | .17 | .35 | .16 | .14 | .14 | .14 | .14 | .16 | .16 | .15 | .21 | .14 | .14 |
| Nylon | 0.35 | .013 | .0169 | 13.700 | .0004 | .670 | .14 | .15 | .14 | .14 | .14 | .15 | .16 | .41 | .15 | .15 | .14 | .15 | .14 | .15 | .18 | .14 | .21 | .15 | .13 |
| Nylon | 0.35 | .013 | .0169 | 17.000 | .0004 | .540 | .14 | .17 | .14 | .15 | .14 | .17 | .17 | .31 | .14 | .15 | .14 | .15 | .14 | .15 | .21 | .15 | .28 | .16 | .14 |
| Nylon | 0.35 | .013 | .0169 | 20.100 | .0004 | .370 | .14 | .14 | .15 | .14 | .14 | .14 | .16 | .30 | .14 | .13 | .14 | .14 | .14 | .15 | .23 | .15 | .21 | .15 | .14 |
| Nylon | 0.35 | .018 | .0088 | 6.700 | .0004 | .480 | .21 | .34 | .14 | .14 | .14 | .15 | .17 | .22 | .14 | .17 | .14 | .14 | .15 | .15 | .15 | .15 | .15 | .15 | .14 |
| Nylon | 0.35 | .018 | .0088 | 9.800 | .0004 | .150 | .14 | .26 | .14 | .14 | .14 | .14 | .15 | .14 | .14 | .14 | .14 | .14 | .14 | .14 | .14 | .14 | .15 | .15 | .14 |

APPENDIX A-continued

| Cup Material | Modulus Million psi | Edge | Ease of Flexture | Force | Plate Flatness | Normal Total | 1 | 2 | 3 | 4 | 5 | 6 | 7 | 8 | 9 | 10 | 11 | 12 | 13 | 14 | 15 | 16 | 17 | 18 | Base |
|---|---|---|---|---|---|---|---|---|---|---|---|---|---|---|---|---|---|---|---|---|---|---|---|---|---|
| Nylon | 0.35 | .018 | .0088 | 13.700 | .0004 | .070 | .14 | .11 | .14 | .14 | .14 | .14 | .14 | .15 | .14 | .14 | .15 | .14 | .15 | .14 | .14 | .14 | .14 | .15 | .14 |
| Nylon | 0.35 | .018 | .0088 | 17.000 | .0004 | .210 | .13 | .14 | .14 | .15 | .15 | .15 | .14 | .15 | .14 | .13 | .15 | .14 | .15 | .13 | .14 | .14 | .14 | .14 | .13 |
| Nylon | 0.35 | .018 | .0088 | 20.100 | .0004 | .170 | .13 | .13 | .14 | .15 | .15 | .14 | .13 | .14 | .13 | .13 | .14 | .14 | .14 | .15 | .14 | .14 | .16 | .13 | .13 |
| Nylon | 0.35 | .013 | .0169 | 6.700 | .0011 | 4.860 | .13 | .13 | .13 | .19 | .13 | .16 | .90 | .50 | 1.09 | .33 | .13 | .13 | .13 | .13 | .14 | .67 | 1.21 | .97 | .13 |
| Nylon | 0.35 | .013 | .0169 | 9.800 | .0011 | 4.590 | .13 | .13 | .13 | .17 | .13 | .16 | .96 | .49 | 1.06 | .24 | .13 | .14 | .13 | .13 | .13 | .56 | 1.15 | .96 | .13 |
| Nylon | 0.35 | .013 | .0169 | 13.700 | .0011 | 4.710 | .14 | .13 | .13 | .17 | .13 | .16 | .95 | .57 | 1.06 | .36 | .13 | .13 | .13 | .13 | .13 | .55 | 1.08 | .97 | .13 |
| Nylon | 0.35 | .013 | .0169 | 17.000 | .0011 | 4.320 | .13 | .13 | .13 | .14 | .14 | .16 | 1.00 | .48 | 1.09 | .27 | .13 | .13 | .14 | .13 | .13 | .44 | 1.01 | .86 | .13 |
| Nylon | 0.35 | .013 | .0169 | 20.100 | .0011 | 4.210 | .13 | .13 | .14 | .18 | .14 | .21 | 1.02 | .43 | 1.06 | .11 | .13 | .13 | .14 | .13 | .14 | .38 | 1.00 | .81 | .13 |
| Nylon | 0.35 | .018 | .0088 | 6.100 | .0011 | 1.730 | .14 | .14 | .13 | .14 | .13 | .14 | .48 | .22 | 1.00 | .14 | .13 | .13 | .14 | .13 | .14 | .14 | .47 | .13 | .13 |
| Nylon | 0.35 | .018 | .0086 | 9.800 | .0011 | .660 | .14 | .13 | .13 | .13 | .14 | .13 | .15 | .13 | .68 | .13 | .13 | .13 | .14 | .13 | .13 | .13 | .18 | .14 | .13 |
| Nylon | 0.35 | .018 | .0088 | 13.700 | .0011 | .460 | .13 | .13 | .13 | .13 | .14 | .13 | .13 | .14 | .55 | .13 | .14 | .13 | .13 | .13 | .13 | .13 | .14 | .13 | .13 |
| Nylon | 0.35 | .018 | 0068 | 17.000 | .0011 | .160 | .14 | .14 | .13 | .13 | .14 | .14 | .13 | .13 | .23 | .13 | .13 | .13 | .14 | .13 | .13 | .13 | .14 | .13 | .13 |
| Nylon | 0.35 | .018 | .0088 | 20.100 | .0011 | .080 | .13 | .13 | .15 | .13 | .14 | .14 | .13 | .13 | .14 | .13 | .14 | .13 | .13 | .14 | .13 | .13 | .14 | .13 | .13 |
| Poly | 0.11 | .020 | .0227 | 6.700 | .0000 | .450 | .13 | .14 | .14 | .14 | .14 | .14 | .14 | .13 | .26 | .32 | .14 | .14 | .15 | .13 | .14 | .14 | .13 | .14 | .13 |
| Poly | 0.11 | .014 | .0464 | 6.100 | .0000 | .290 | .14 | .13 | .13 | .14 | .14 | .14 | .14 | .14 | .14 | .14 | .13 | .13 | .13 | .14 | .13 | .14 | .13 | .14 | .12 |
| Poly | 0.11 | .020 | .0227 | 9.800 | .0000 | .380 | .13 | .15 | .14 | .14 | .14 | .15 | .14 | .15 | .16 | .34 | .14 | .14 | .14 | .13 | .13 | .14 | .13 | .13 | .13 |
| Poly | 0.11 | .014 | .0464 | 9.800 | .0000 | .000 | .12 | .12 | .12 | .12 | .12 | .12 | .12 | .12 | .12 | .12 | .12 | .12 | .12 | .12 | .12 | .12 | .12 | .12 | .12 |
| Poly | 0.11 | .020 | .0221 | 13.700 | .0000 | .270 | .14 | .14 | .14 | .14 | .13 | .14 | .14 | .14 | .19 | .25 | .13 | .13 | .14 | .13 | .13 | .14 | .13 | .13 | .13 |
| Poly | 0.11 | .020 | .0227 | 17.000 | .0000 | .180 | .13 | .12 | .14 | .13 | .13 | .15 | .13 | .16 | .17 | .21 | .14 | .13 | .14 | .12 | .13 | .13 | .13 | .13 | .13 |
| Poly | 0.11 | .020 | .0227 | 20.100 | .0000 | .090 | .13 | .14 | .14 | .14 | .14 | .19 | .13 | .21 | .15 | .18 | .13 | .13 | .13 | .14 | .13 | .13 | .14 | .13 | .14 |
| Poly | 0.11 | .020 | .0227 | 6.700 | .0010 | 7.030 | .12 | .13 | .35 | .58 | .23 | 1.17 | .92 | 1.26 | 1.09 | .41 | .13 | .14 | .80 | .19 | .94 | .16 | .43 | .14 | .12 |
| Poly | 0.11 | .020 | .0227 | 9.800 | .0010 | 6.850 | .13 | .13 | .23 | .38 | .14 | 1.07 | .71 | 1.19 | 1.02 | .41 | .13 | .14 | 1.01 | .42 | 1.06 | .37 | .51 | .14 | .13 |
| Poly | 0.11 | .620 | .0221 | 13.700 | .0010 | 5.210 | .13 | .13 | .20 | .43 | .16 | 1.10 | .68 | 1.21 | 1.09 | .44 | .13 | .13 | .58 | .14 | .57 | .14 | .15 | .14 | .13 |
| Poly | 0.11 | .020 | .0227 | 17.000 | .0010 | 4.630 | .13 | .13 | .15 | .40 | .14 | 1.08 | .86 | 1.19 | 1.10 | .49 | .14 | .13 | .31 | .14 | .17 | .14 | .13 | .14 | .13 |
| Poly | 0.11 | .020 | .0227 | 20.100 | .0010 | 4.190 | .13 | .13 | .15 | .40 | .14 | 1.07 | .68 | 1.20 | 1.07 | .45 | .14 | .13 | .16 | .13 | .14 | .14 | .14 | .13 | .13 |
| Poly | 0.11 | .014 | .0464 | 6.700 | .0010 | 1.630 | .13 | .13 | .13 | .13 | .14 | .14 | .14 | .44 | .14 | .13 | .14 | .14 | .51 | .13 | .92 | .14 | .20 | .14 | .13 |
| Poly | 0.11 | .014 | .0464 | 6.700 | .0010 | .460 | .14 | .14 | .14 | .14 | .14 | .14 | .14 | .18 | .14 | .14 | .14 | .15 | 14 | .14 | .38 | .13 | .14 | .14 | .13 |
| Poly | 0.11 | .014 | .0464 | 9.800 | .0010 | .970 | .13 | .14 | .13 | .14 | .13 | .14 | .13 | .24 | .13 | .13 | .13 | .13 | .31 | .13 | .58 | .13 | .14 | .14 | 12 |
| Poly | 0.11 | .014 | .0464 | 9.800 | .0010 | .000 | .13 | .13 | .13 | .13 | .13 | .13 | .13 | .13 | .13 | .13 | .13 | .13 | .13 | .13 | .13 | .13 | .13 | .13 | .13 |
| Poly | 0.11 | .014 | .0464 | 13.700 | .0010 | .070 | .13 | .15 | .13 | .13 | .13 | .14 | .13 | .13 | .13 | .13 | .13 | .13 | .13 | .14 | .14 | .13 | .14 | .14 | .13 |
| Poly | 0.11 | .014 | .0464 | 17.000 | .0010 | .050 | .14 | .14 | .13 | .13 | .14 | .13 | .13 | .14 | .12 | .12 | .13 | .13 | .13 | .14 | .14 | .14 | .13 | .13 | .13 |
| Poly | 0.11 | .014 | .0464 | 20.100 | .0010 | .250 | .13 | .13 | .14 | .13 | .14 | .13 | .13 | .14 | .13 | .13 | .13 | .14 | .13 | .14 | .14 | .14 | .13 | .13 | .12 |
| Poly | 0.11 | .014 | .0464 | 6.700 | .0011 | 6.990 | .14 | .13 | .14 | .13 | .14 | .32 | .13 | 1.03 | .13 | .14 | .14 | .74 | 1.26 | .94 | 1.27 | .13 | 1.19 | .63 | .13 |
| Poly | 0.11 | .014 | .0464 | 9.800 | .0017 | 3.750 | .13 | .13 | .13 | .14 | .13 | .13 | .14 | .35 | .13 | .13 | .13 | .32 | 1.20 | .29 | 1.25 | .15 | 1.07 | .14 | .13 |
| Poly | 0.11 | .014 | .0464 | 13.700 | .0017 | 2.560 | .14 | .13 | .13 | .13 | .13 | .13 | .14 | .13 | .14 | .13 | .13 | .14 | 1.10 | .14 | 1.18 | .14 | .61 | .13 | .13 |
| Poly | 0.11 | .014 | .0464 | 17.000 | .0017 | 1.890 | .13 | .13 | .13 | .14 | .14 | .13 | .13 | .14 | .14 | .13 | .14 | .13 | .91 | .14 | 1.16 | .14 | .14 | .13 | .13 |
| Poly | 0.11 | .014 | .0464 | 20.100 | .0011 | 1.100 | .14 | .14 | .14 | .13 | .13 | .14 | .13 | .14 | .13 | .13 | .14 | .14 | .32 | .14 | .76 | .13 | .14 | .14 | .12 |
| Poly | 0.11 | .018 | .0281 | 6.700 | .0004 | .630 | .14 | .15 | .14 | .14 | .14 | .14 | .14 | .14 | .14 | .14 | .16 | .14 | .15 | .15 | .17 | .34 | .39 | .24 | .14 |
| Poly | 0.11 | .018 | .0281 | 9.800 | .0004 | .720 | .14 | .16 | .13 | .14 | .13 | .13 | .13 | .14 | .14 | .14 | .14 | .13 | .14 | .15 | .15 | .25 | .45 | .27 | .13 |
| Poly | 0.11 | .018 | .0261 | 13.100 | .0004 | .220 | .14 | .14 | .14 | .14 | .14 | .14 | .14 | .14 | .14 | .14 | .14 | .14 | .14 | .14 | .14 | .17 | .29 | .18 | .14 |
| Poly | 0.11 | .018 | .0281 | 17.000 | .0004 | .380 | .13 | .16 | .13 | .13 | .13 | .13 | .13 | .14 | .13 | .13 | .13 | .13 | .14 | .14 | .13 | .18 | .32 | .21 | .13 |
| Poly | 0.11 | .018 | .0281 | 20.100 | .0004 | .220 | .13 | .13 | .13 | .14 | .13 | .14 | .13 | .14 | .13 | .13 | .13 | .13 | .13 | .14 | .13 | .16 | .19 | .22 | .13 |
| Poly | 0.11 | .013 | .0538 | 6.700 | .0004 | .650 | .14 | .14 | .14 | .14 | .14 | .14 | .18 | .27 | .81 | .14 | .14 | .14 | .15 | .14 | .14 | .11 | .14 | .14 | .14 |
| Poly | 0.11 | .013 | .0538 | 9.800 | .0004 | .390 | .14 | .14 | .14 | .15 | .14 | .14 | .16 | .17 | .46 | .14 | .14 | .14 | .14 | .15 | .14 | .14 | .14 | .14 | .14 |
| Poly | 0.11 | .013 | .0538 | 13.700 | .0004 | .050 | .14 | .4 | .14 | .14 | .15 | .14 | .14 | .15 | .16 | .15 | .14 | .14 | .14 | .14 | .14 | .11 | .14 | .14 | .14 |
| Poly | 0.11 | .013 | .0538 | 17.000 | .0004 | .030 | .15 | .14 | .14 | .14 | .14 | .14 | .14 | .14 | .15 | .14 | .14 | .14 | .14 | .14 | .14 | .14 | .15 | .14 | .14 |
| Poly | 0.11 | .013 | .0538 | 20.100 | .0004 | .000 | .14 | .14 | .14 | .14 | .14 | .14 | .14 | .14 | .14 | .14 | .14 | .14 | .14 | .14 | .14 | .14 | .14 | .14 | .14 |
| Poly | 0.11 | .010 | .0281 | 6.700 | .0011 | 3.280 | .13 | .13 | .18 | .13 | .13 | .13 | .85 | .22 | 1.12 | .49 | .13 | .13 | .13 | .13 | .15 | .18 | .91 | .32 | .13 |
| Poly | 0.11 | .018 | .0281 | 9.800 | .0011 | 2.030 | .13 | .13 | .13 | .13 | .13 | .14 | .10 | .15 | .95 | .32 | .13 | .13 | .14 | .13 | .13 | .13 | .44 | .20 | .13 |

APPENDIX A-continued

| Cup Material | Modulus Million psi | Edge | Ease of Flexture | Force | Plate Flatness | Normal Total | 1 | 2 | 3 | 4 | 5 | 6 | 7 | 8 | 9 | 10 | 11 | 12 | 13 | 14 | 15 | 16 | 17 | 18 | Base |
|---|---|---|---|---|---|---|---|---|---|---|---|---|---|---|---|---|---|---|---|---|---|---|---|---|---|
| Poly | 0.11 | .018 | .0281 | 13.700 | .0011 | .910 | .13 | .13 | .13 | .13 | .13 | .13 | .48 | .14 | .62 | .14 | .13 | .13 | .14 | .14 | .14 | .14 | .13 | .14 | .13 |
| Poly | 0.11 | .018 | .0281 | 17.000 | .0011 | .390 | .13 | .13 | .13 | .13 | .13 | .13 | .19 | .14 | .39 | .14 | .14 | .13 | .14 | .14 | .14 | .13 | .14 | .13 | .13 |
| Poly | 0.11 | .018 | .0261 | 20.100 | .0011 | .080 | .13 | .14 | .13 | .13 | .13 | .13 | .14 | .13 | .16 | .13 | .14 | .13 | .13 | .13 | .11 | .13 | .14 | .13 | .13 |
| Poly | 0.11 | .013 | .0536 | 6.700 | .0011 | 4.520 | .14 | .13 | .13 | .15 | .14 | .14 | 1.10 | .40 | 1.22 | 1.09 | .14 | .14 | .14 | .14 | .34 | .19 | .96 | .17 | .13 |
| Poly | 0.11 | .013 | .0538 | 9.800 | .0011 | 3.610 | .14 | .14 | .14 | .14 | .13 | .14 | .80 | .51 | 1.14 | .83 | .13 | .14 | .14 | .14 | .16 | .18 | .69 | .20 | .13 |
| Poly | 0.11 | .013 | .0538 | 13.700 | .0011 | 1.320 | .14 | .14 | .14 | .13 | .13 | .14 | .24 | .15 | .87 | .21 | .13 | .14 | .13 | .13 | .13 | .14 | .42 | .16 | .13 |
| Poly | 0.11 | .013 | .0538 | 17.000 | .0011 | .640 | .14 | .13 | .14 | .14 | .14 | .15 | .15 | .14 | .53 | .15 | .13 | .13 | .14 | .14 | .13 | .14 | .22 | .14 | .13 |
| Poly | 0.11 | .013 | .0538 | 20.100 | .0011 | .170 | .13 | .13 | .13 | .13 | .14 | .14 | .14 | .14 | .15 | .14 | .14 | .14 | .14 | .14 | .13 | .13 | .15 | .14 | .13 |
| Steel | 23.60 | .010 | .0004 | 6.700 | .0000 | .270 | .13 | .16 | .14 | .15 | .14 | .14 | .14 | .15 | .14 | .18 | .13 | .14 | .15 | .14 | .16 | .13 | .15 | .14 | .13 |
| Steel | 23.60 | .010 | .0084 | 9.800 | .0000 | .250 | .13 | .14 | .13 | .16 | .14 | .14 | .15 | .14 | .14 | .11 | .15 | .14 | .14 | .14 | .14 | .14 | .16 | .14 | .13 |
| Steel | 23.60 | .010 | .0004 | 13.700 | .0000 | .160 | .13 | .14 | .13 | .13 | .14 | .14 | .14 | .14 | .14 | .14 | .14 | .14 | .14 | .14 | .14 | .14 | .15 | .14 | .13 |
| Steel | 23.60 | .010 | .0004 | 17.000 | .0000 | .220 | .14 | .13 | .13 | .14 | .14 | .16 | .14 | .14 | .15 | .14 | .14 | .14 | .14 | .14 | .16 | .14 | .15 | .14 | .13 |
| Steel | 23.60 | .010 | .0004 | 20.100 | .0000 | .160 | .14 | .14 | .14 | .14 | .14 | .14 | .14 | .14 | .14 | .14 | .13 | .14 | .14 | .13 | .14 | .14 | .14 | .14 | .13 |
| Steel | 23.60 | .010 | .0004 | 6.700 | .0010 | 2.230 | .13 | .14 | .13 | .14 | .14 | .43 | .14 | .79 | .17 | .17 | .13 | .14 | .85 | .20 | .54 | .14 | .23 | .14 | .14 |
| Steel | 23.60 | .010 | .0004 | 6.700 | .0010 | 3.170 | .14 | .14 | .14 | .14 | .43 | 1.02 | .15 | 1.13 | .14 | .14 | .14 | .13 | .59 | .26 | .38 | .15 | .15 | .14 | .13 |
| Steel | 23.60 | .010 | .0004 | 9.800 | .0010 | 1.410 | .13 | .14 | .14 | .13 | .14 | .31 | .14 | .56 | .22 | .16 | .13 | .13 | .46 | .20 | .26 | .14 | .18 | .14 | .13 |
| Steel | 23.60 | .010 | .0004 | 9.800 | .0010 | 3.050 | .14 | .13 | .13 | .14 | .14 | .48 | .13 | .42 | .13 | .14 | .13 | .13 | 1.04 | .76 | 1.10 | .14 | .15 | .14 | .14 |
| Steel | 23.60 | .010 | .0004 | 13.700 | 0010 | .630 | .12 | .14 | .14 | .13 | .14 | .20 | .15 | .42 | .13 | .14 | .14 | .13 | .40 | .14 | .20 | .14 | .15 | .14 | .14 |
| Steel | 23.60 | .010 | .0004 | 13.700 | .0000 | 2.280 | .14 | .13 | .13 | .13 | .14 | .55 | .14 | .60 | .14 | .13 | .14 | .15 | .96 | .56 | .35 | .14 | .15 | .14 | .14 |
| Steel | 23.60 | .010 | .0004 | 11.000 | .0010 | .770 | .14 | .14 | .13 | .14 | .13 | .20 | .14 | .30 | .15 | .18 | .14 | .13 | .43 | .13 | .19 | .13 | .16 | .15 | .13 |
| Steel | 23.60 | .010 | .0004 | 17.000 | .0010 | 1.730 | .14 | .13 | .13 | .15 | .14 | .53 | .14 | .25 | .14 | .14 | .13 | .78 | .37 | .35 | .14 | .14 | .14 | .13 | .13 |
| Steel | 23.60 | .010 | .0004 | 20.100 | .0010 | .520 | .14 | .14 | .14 | .13 | .13 | .17 | .14 | .33 | .14 | .14 | .13 | .13 | .14 | .13 | .13 | .13 | .15 | .14 | .12 |
| Steel | 23.60 | .010 | .0004 | 20.100 | .0010 | 1.390 | .13 | .14 | .14 | .14 | .14 | .51 | .13 | .35 | .13 | .13 | .13 | .14 | .63 | .28 | .21 | .13 | .14 | .13 | .13 |
| Steel | 23.60 | .010 | .0004 | 6.700 | .0017 | 9.040 | .14 | .13 | .63 | .34 | .63 | 1.28 | .58 | 1.29 | .55 | .14 | .18 | .13 | 1.26 | 1.24 | 1.28 | .75 | .10 | .17 | .13 |
| Steel | 23.60 | .010 | .0004 | 9.800 | .0017 | 7.380 | .13 | .13 | .45 | .17 | .54 | 1.26 | .33 | 1.30 | .29 | .13 | .15 | .13 | 1.29 | 1.23 | 1.27 | .45 | .31 | .16 | .13 |
| Steel | 23.60 | .010 | .0004 | 13.700 | .0017 | 6.520 | .13 | .14 | .15 | .13 | .45 | 1.28 | .27 | 1.25 | .25 | .13 | .13 | .13 | 1.29 | 1.21 | 1.26 | .30 | .18 | .14 | .13 |
| Steel | 23.80 | .010 | .0004 | 17.000 | .0017 | 5.714 | .15 | .14 | .20 | .13 | 21 | 1.24 | .17 | 1.25 | .20 | .13 | .14 | .14 | 1.27 | 1.21 | 1.23 | .15 | .14 | .13 | .14 |
| Steel | 23.60 | .010 | .0004 | 20.100 | .0017 | 6.040 | .14 | .13 | .14 | .18 | .30 | 1.24 | .16 | .1.28 | .15 | .13 | .14 | .13 | 1.28 | 1.24 | 1.29 | .22 | .14 | .14 | .13 |

What is claimed is:

1. A doctoring cup for transferring ink to a plate, comprising a cup base and a cup wall extending from said base, said cup base and said cup wall defining a chamber for containing ink, said cup wall including a plate contacting edge, said plate contacting edge having an ease of flex greater than about 0.020 $lb^{-1}$.

2. The doctoring cup of claim 1 wherein said ease of flex is in the range of about 0.020 to 0.80 $lb^{-1}$.

3. The doctoring cup of claim 1 wherein said plate contacting edge has an edge thickness in the range of about 0.005 to 0.030 inches.

4. The doctoring cup of claim 1 wherein said cup wall has a flexural modulus in the range of about 50,000 to 1,700,000 PSI.

5. The doctoring cup of claim 1 wherein said cup wall is formed from a material selected from the group consisting of delrin, nylon, and polyethylene.

6. The doctoring cup of claim 1 wherein said cup wall has an outer diameter in the range of about 2.250 to 2.245 inches and tapers at a radius of about 0.125 inch to a smaller diameter to form said plate contacting edge.

7. The doctoring cup of claim 1 for use with non-flat printing plates.

8. A method of printing, comprising providing a doctoring cup comprising a cup base and a cup wall extending from said base, said cup base and said cup wall defining a chamber for containing ink, said cup wall including a plate contacting edge, said plate contacting edge having an ease of flex greater than about 0.020 $lb^{-1}$, placing ink in said chamber, and inking a printing plate with said doctoring cup.

9. The method of claim 8 wherein inking said printing plate comprises inking a non-flat printing plate.

10. A doctoring system, comprising a doctoring cup for transferring ink to a printing plate, comprising a cup base and a cup wall extending from said base, said cup base and said cup wall defining a chamber for containing ink, said cup wall including a plate contacting edge, said plate contacting edge having an ease of flex greater than about 0.020 $lb^{-1}$, and a printing plate.

11. The doctoring system of claim 10 wherein said printing plate comprises a non-flat plate.

12. A method of doctoring non-flat printing plates, comprising:

providing a doctoring cup defining a chamber for containing ink, placing ink in said chamber, and inking said non-flat printing plate using a doctoring pressure less than 300 psi.

13. A method of designing a doctoring cup for doctoring a non-flat plate, comprising determining an acceptable range of ease of flex values for a doctoring cup having a particular modulus and edge thickness that will allow the cup to ink a non-flat plate at a desired doctoring quality.

14. The method of claim 13 wherein said determining an acceptable range of ease of flex values comprises:

(a) providing a first doctoring cup having a given geometry, (b) doctoring the non-flat plate, (c) testing the quality of the doctoring, (d) providing a second doctoring cup having the given geometry and an edge thickness or a modulus that is different from said first doctoring cup, and repeating steps (b) and (c).

15. The method of claim 14 wherein said second doctoring cup is provided with an edge thickness and a modulus that is different from said first doctoring cup.

* * * * *